US007725055B2

(12) United States Patent
Smeyers et al.

(10) Patent No.: US 7,725,055 B2
(45) Date of Patent: May 25, 2010

(54) ROLLER FOR A PRINTER AND A METHOD OF COOLING THE ROLLER SURFACE

(75) Inventors: Johannes H. L. Smeyers, Venlo (NL); Ernest J. J. Clevers, Broekhuizenvorst (NL); Rob W. M. Janssen, Venlo (NL); Wilhelmus M. Van Herpen, Velden (NL)

(73) Assignee: OCE-Technologies B.V., Venlo (NL)

( * ) Notice: Subject to any disclaimer, the term of this patent is extended or adjusted under 35 U.S.C. 154(b) by 512 days.

(21) Appl. No.: 11/812,652

(22) Filed: Jun. 20, 2007

(65) Prior Publication Data

US 2008/0014003 A1 Jan. 17, 2008

(30) Foreign Application Priority Data

Jun. 21, 2006 (EP) ..... 06115805

(51) Int. Cl.
*G03G 15/00* (2006.01)
*G03G 21/16* (2006.01)
*F24H 1/28* (2006.01)

(52) U.S. Cl. ..... 399/159; 399/107; 165/89; 165/90

(58) Field of Classification Search ..... 165/90, 165/89; 399/159, 107
See application file for complete search history.

(56) References Cited

U.S. PATENT DOCUMENTS

RE25,927 E * 12/1965 Justus et al. ..... 165/89
3,633,663 A * 1/1972 Tafel ..... 165/89
3,752,227 A 8/1973 Bulson
3,870,100 A * 3/1975 Korting et al. ..... 165/89
4,077,466 A * 3/1978 Fleissner ..... 165/89
4,607,936 A 8/1986 Miyakawa et al.
5,788,382 A 8/1998 Egbert et al.
2006/0127131 A1* 6/2006 Fujishiro et al. ..... 399/159
2008/0187359 A1* 8/2008 Kamoshida et al. ..... 399/159

FOREIGN PATENT DOCUMENTS

GB 1000235 8/1965
JP 2-99253 A 4/1990
JP 2007101788 A * 4/2007

OTHER PUBLICATIONS

"Cooling Drum" , 2244 Research Disclosure, Mason Publications, Hamshire, GB, No. 316, Aug. 1, 1990, p. 600, XP000140910.

* cited by examiner

*Primary Examiner*—Daniel J Colilla
(74) *Attorney, Agent, or Firm*—Birch, Stewart, Kolasch & Birch, LLP

(57) ABSTRACT

A roller for a printer includes an outer tube and at least one inner tube. The inner tube is position within the outer tube. The outer tube extends in an axial direction from a first to a second end and the inner tube extends substantially parallel to the outer tube, defining an inter tubular space between the outer and the inner tube and an intra tubular space within the inner tube. The roller also includes a blocking element dividing the inter tubular space and the intra tubular space into a first part extending substantially from the first end to the blocking element and a second part extending substantially from the blocking element to the second end. A first and a second duct connects the first and second part of the inter tubular space with the second and first part, respectively, of the intra tubular space via the blocking element.

18 Claims, 4 Drawing Sheets

ROLLER FOR A PRINTER AND A METHOD OF COOLING THE ROLLER SURFACE

CROSS-REFERENCE TO RELATED APPLICATIONS

This nonprovisional application claims priority under 35 U.S.C. §119(a) on Patent Application No. 06115805.1, filed in the European Patent Office on Jun. 21, 2006, the entirety of which is incorporated herein by reference.

BACKGROUND OF THE INVENTION

1. Field of the Invention

The present invention pertains to a roller for a printer comprising an outer tube and positioned therein at least one inner tube. The outer tube extends in an axial direction from a first end to a second end and the inner tube extends substantially parallel to the outer tube, defining an inter tubular space between the outer and the inner tube and an intra tubular space within the inner tube.

The present invention also pertains to a printing system including such a roller and a method of cooling the surface of such a roller.

2. Description of Background Art

Such rollers are commonly applied in, e.g. electrophotographic printers. Rollers of this type are, e.g. used as image-bearing rollers or as cooling rollers. These are rollers that absorb heat in their operation and that require cooling of their surface. The cooling is usually done by blowing or sucking air through the interior of the roller with a fan.

Image-bearing rollers are, e.g. rollers that are covered with a photoconductive layer or with an electrode pattern. This enables the formation of an electrostatic image on the surface of the image-bearing roller. In a subsequent step, a layer of toner particles is developed onto the electrostatic image on the image-bearing roller. This toner image is subsequently transferred to the receiving substrate and fused with the receiving substrate.

During the operation of the printer, the surface temperature of the image-bearing roller tends to increase. If the surface temperature rises too high, the toner particles will fuse and stick to the surface of the image-bearing roller resulting in print artifacts. Therefore, the surface of the image-bearing roller requires cooling by, e.g. blowing air through the roller.

Rollers according to the background art are also used as cooling rollers. When such a roller is rotatably contacted with a substrate it will drain heat from that substrate thus cooling the substrate. The heat taken up by the cooling roller is then discharged with the air flow that passes through the roller. Optionally, it is also possible to discharge the heat with a flow of a liquid cooling agent that runs through the roller.

The disadvantage of the rollers according to the background art is that a temperature gradient is formed in an axial direction along the surface. This is because the cold air that is blown into the inter tubular space of the roller immediately exchanges heat with the surface of the roller. Thus, when progressing through the roller, the air flow temperature increases. This reduces the temperature difference between the air flow and the surface of the roller. This subsequently leads to a reduced cooling capacity of the air flow near the end of the roller which results in a temperature gradient over the roller. Because of this temperature gradient, the air flow must be sufficiently high in order to reach a specified temperature at the end to the roller. This leads to a relatively inefficient cooling system.

SUMMARY OF THE INVENTION

An object of the present invention is to provide a roller that has an improved cooling efficiency by reducing the temperature gradient over the roller.

According to an embodiment of the present invention, a roller for a printer comprises an outer tube, said outer tube extending in an axial direction from a first end to a second end; at least one inner tube positioned within the outer tube, said at least one inner tube extending substantially parallel to the outer tube, an inter tubular space being defined between the outer tube and the inner tube, and an intra tubular space being defined within the inner tube; a blocking element, said blocking element dividing the inter tubular space and the intra tubular space into a first part extending substantially from the first end to the blocking element and a second part extending substantially from the blocking element to the second end; and a first duct and a second duct connecting the first part and the second part of the inter tubular space with the second part and first part, respectively, of the intra tubular space via the blocking element.

The blocking element can be a disk like object that fits into the outer tube and extends though the inner tube, dividing both the intra tubular space and the inter tubular space into a first and a second part. The blocking element can entirely or partially block the flow through the roller and can be, e.g. an injection molded plastic object.

The outer tube can include lamellae that extend from the inner surface into the inter tubular space and stretch out along the longitudinal axis of the roller. These lamellae increase the inner surface area of the outer tube, which increases the effective contact area with the flow and thus increases the heat exchange capacity. The blocking element is configured such that it fits in the outer tube and has radial cuts from the outside inwards that allow the lamellae to pass through the blocking element. The size of these radial cuts can be adapted to control the fraction of the flow that is blocked and the fraction that is allowed to continue its path through the inter tubular space.

In order to allow the air flow to pass through the roller, a first and a second duct are present extending through the blocking element and connecting the inter tubular space with the intra tubular space. This allows air that is blown into any of the first and the second part of inter tubular space to pass through the duct and to exit the roller via any of the first and the second part of the intra tubular space. Alternatively, air that is blown into any of the first and the second part of the intra tubular space can exit the roller through any of the first and the second part of the inter tubular space.

For example, air can be blown simultaneously into the first and the second part of the inter tubular space from both directions, using two fan units. The flow that is blown into the first part of the inter tubular space can exit the roller via the first part of the intra tubular space. The air flow that is simultaneously blown into the second part of the inter tubular space can exit the roller via the second part of the intra tubular space.

Preferably, the blocking element is positioned at a central position along the axis of the roller. In this way, the air that is blown through the first part of the inter tubular space and that cools the surface of the roller cools only half of the roller surface. The surface temperature gradient over the first part of the roller is the same as in the absence of the blocking element. However, in the absence of a blocking element, the second part of the roller surface will experience approximately the same gradient in surface temperature as in the first part resulting in a cumulative gradient in surface temperature over the entire roller surface of approximately two times the temperature gradient over the first part. In the embodiment incorporating the blocking element, every stream of air is allowed to cool only half of the roller surface. Therefore, the gradient in surface temperature over the entire roller surface is not cumulative, but rather the first part and the second part of the surface independently experience the same gradient in surface temperature. The extreme temperature differences over the roller surface are thus reduced by approximately a factor of two, with respect to the situation without the blocking element.

In a further embodiment, the first and the second duct each connect one of the first and the second part of the inter tubular space with the opposing first or second part of the intra tubular space. This allows air to be blown through the roller from one direction. Air that is, e.g. blown into the first part of the inter tubular space, serves to cool the first part of the roller surface and exits the roller via the second part of the intra tubular space, where it does not cool the surface of the roller. Air that is simultaneously blown into the first part of the intra tubular space, where it does not cool the surface of the roller, passes through the second duct and exits the roller via the second part of the inter tubular space where it cools the surface of the roller.

The flow rate through the roller can be optimized by choosing a high number of ducts and a large diameter of the ducts. It is also preferred to keep the curvature of the ducts as low as possible to obtain the lowest friction of the air flow with the duct walls.

It has been observed that for a given air pressure generated by the fan, a higher air flow through the inter tubular space can be realized with this roller system compared to the roller without the blocking element. The present roller system thus also has an improved cooling capacity with respect to the situation without the blocking element.

In another embodiment, the first duct and the second duct are arranged to form a double helix. This means that the entrance of, e.g. the first duct on the first side of the inter tubular space lies radially above the entrance of the second duct on the same side of the intra tubular space. The exit of the first duct on the second side of the intra tubular space then lies radially underneath the exit of the second duct on the second side of the inter tubular space. The two ducts thus form a twisted pair, also called a double helix, with a half pitch. In the middle of the blocking element, the two ducts are tangentially juxtaposed. To obtain the maximal air flow through the roller, a plurality of duct pairs can be used.

In yet another embodiment, the blocking element is not longer than 40 mm in the axial direction. Because there is no air flow for cooling the roller surface at the site of the blocking element, the roller surface temperature can become relatively high at that location. Therefore, it is favorable to keep the axial dimension of the blocking element as low as possible. However, the narrower the blocking element, the stronger the curvature of the ducts, which results in an increased friction of the air flow with the duct walls which hampers the air flow through the blocking element. The axial dimension of the blocking element is therefore a trade-off between realizing a sufficiently high air flow through the roller and minimizing the jump in surface temperature of the roller surface due to the presence of the blocking element.

In yet another embodiment, the blocking element is constituted of two parts joined by a gasket. The blocking element can, e.g. consist of two discs that entirely or partially divide the inter and intra tubular spaces, and which are joined by a gasket. The ducts that pass through the blocking element are thus segmented into a first and a second part. Every individual disk contains a quarter of a pitch of the duct pairs. Having a blocking element that consists of two separate discs has the advantage that the separate disks are easier to manufacture by, e.g. injection molding. The gasket can be made from, e.g. a metal, a rubber or a plastic sheet and contains holes to connect the corresponding ducts from the first and the second disk constituting the blocking element.

The two disks constituting the blocking element can also be of approximately the size of the inner tube, and thus only divide the intra tubular space. The gasket can then extend into the inter tubular space to divide the inter tubular space. This embodiment has the advantage that the contact area of the gasket with the outer tube is only very narrow. Therefore the surface area of the roller that is not cooled by the air flow is almost negligible and there is hardly any jump in the surface temperature of the roller.

The invention also pertains to a method of cooling the surface of a roller for a printer as described above, the method comprising transporting air from the first end of the roller to the second end of the roller and leading air that moves through the first part of the inter tubular space into the second part of the intra tubular space via the first duct and leading air that moves through the first part of the intra tubular space into the second part of the inter tubular space by way of the second duct in the blocking element. An air flow can, e.g. be blown or sucked though the roller with a fan.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
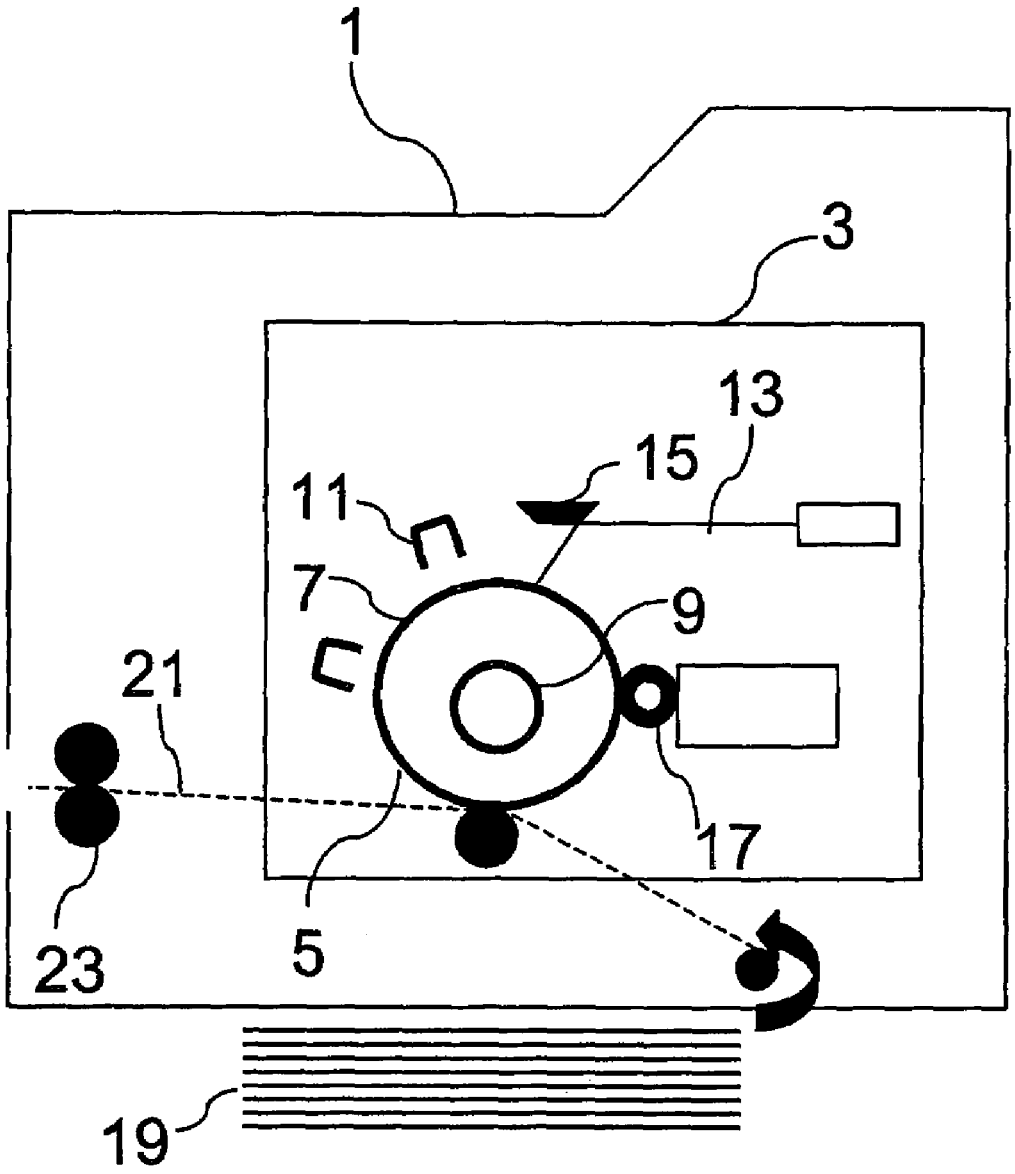
FIG. 1 is a schematic representation of a printer comprising an image-bearing roller according to the present invention.

FIG. 1 shows a schematic drawing of an electrophotographic printer 1. The operation of an electrophotographic printer is known in the background art. The heart of the printer 1 is the print engine 3. The print engine 3 includes an image-bearing roller 5. The image-bearing roller 5 includes an outer tube 7 and an inner tube 9. A photoconductive layer (not shown) is applied on the surface of the image-bearing roller 5. The photoconductive layer which is an insulator in the dark and a conductor when exposed to light. Initially, the photoconductive layer is given a total positive charge by the charge corona wire 11, which is a wire with an electrical current running through it. As the drum revolves, the printer shines a tiny laser beam 13 across the surface to discharge certain points, by reflecting the laser beam on a movable polygonal mirror 15. In this way, the laser "draws" the letters and images to be printed as a pattern of electrical charges, i.e. an electrostatic image. After the pattern is set, the toner supply roller 17 coats the photoconductive layer with positively charged toner, i.e. a fine, black powder. Since it has a positive charge, the toner clings to the negative discharged areas of the photoconductive layer, but not to the positively charged "background." With the powder pattern affixed, the image-bearing roller 5 rolls over a sheet of paper that has been separated from the paper stack 19 and which is moving along below a belt 21. Before the paper rolls under the image-bearing roller, it is given a negative charge by a transfer corona wire (not shown). This charge is stronger than the negative charge of the electrostatic image, so the paper can pull the toner powder away. Since it is moving at the same speed as the image-bearing roller 5, the paper picks up the image pattern exactly. Finally, the printer passes the paper through the fuser 23, i.e. a pair of heated rollers. As the paper passes through these rollers, the loose toner powder melts, fusing with the fibers in the paper. The fuser rolls the paper to the output tray (not shown). The surface temperature of the image-bearing roller 5 tends to increase during operation. The surface temperature may; however, not exceed the melting temperature of the toner powder because then toner powder will fuse with the photoconductive layer on the image-bearing roller, resulting in print artifacts. Therefore, a fan-unit (not shown) blows air through the inner tube 9 and the outer tube 7 in order to cool the surface of the image-bearing member.

Figure 2:
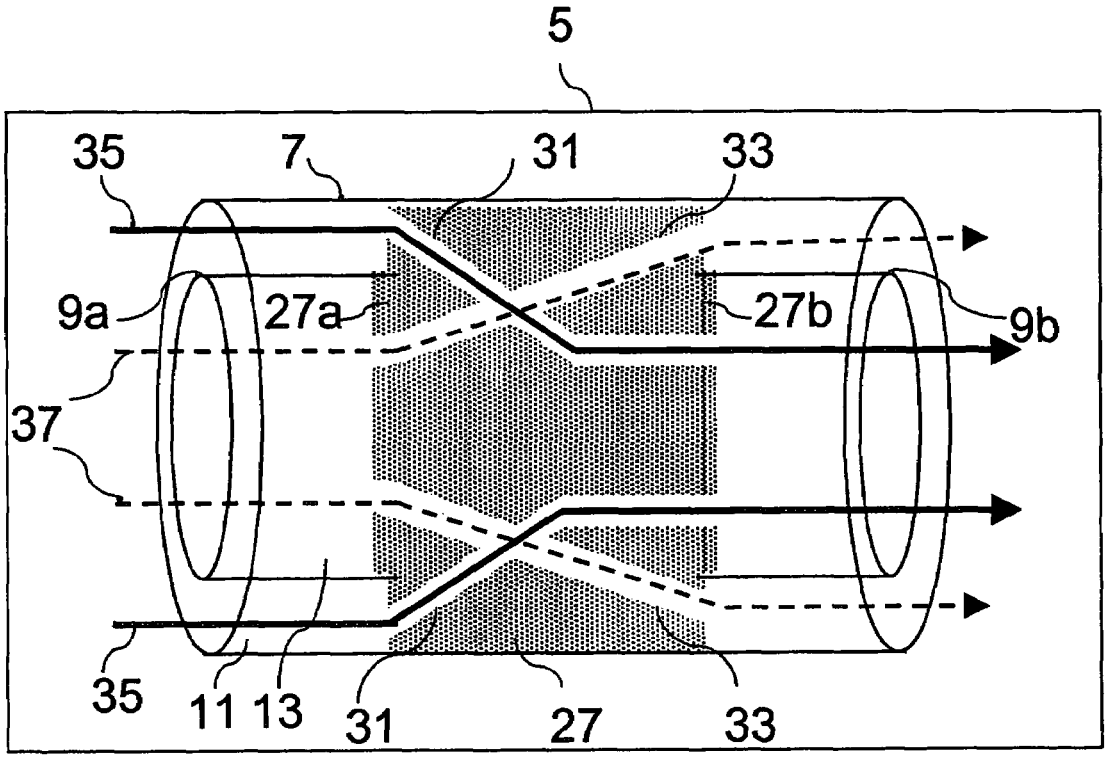
FIG. 2 is a schematic representation of an embodiment of a roller according to the present invention.

FIG. 2 shows a schematic representation of the image-bearing roller 5. The imaging member includes an outer tube 7, two inner tubes 9*a* and 9*b* and a central axis (not shown). The tubes define an inter tubular space 11 and an intra tubular space 13. A blocking element 27 is a one-piece disk that fits tightly into the outer tube. The blocking element 27 has two disk-like protrusions 27*a* and 27*b* that operatively engage the inner tubes 9*a* and 9*b*. Flows of air 35 and 37 are transported through the roller from the left to the right. The inter tubular space 11 and the intra tubular space 13 are divided in a first part upstream of the blocking element and a second part downstream of the blocking element. Ducts 31 in the blocking element guide the flow of air 35 from the upstream part of the inter tubular space 11 to the downstream part of the intra tubular space 13. Ducts 33 guide the air flow 37 from the upstream part of the intra tubular space 13 to the downstream part of the inter tubular space 11. In this manner, air flow 35 cools the first part of the roller surface and the air flow 37 cools the second part of the roller surface. The duct pair 31-33 forms a double helix with a half pitch. The entrances of both ducts are radially aligned, with the entrance of duct 31 lying further away from the central axis than the entrance of duct 33. The exits of both ducts are also radially aligned with the exit of duct 33 lying further away from the central axis than the exit of duct 31.

Figure 3:
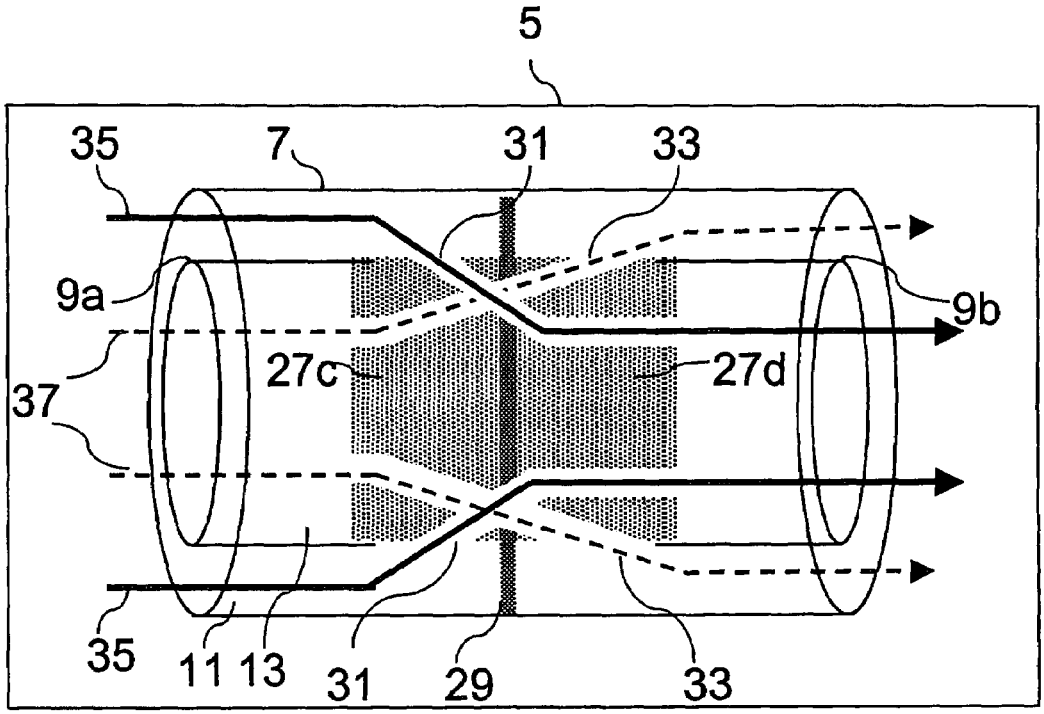
FIG. 3 is a schematic representation of another embodiment of a roller according to the present invention.

FIG. 3 is a schematic representation of another embodiment of the image-bearing roller 5. The imaging member includes an outer tube 7, two inner tubes 9*a* and 9*b* and the central axis (not shown). The tubes define an inter tubular space 11 and an intra tubular space 13. The blocking member 27 includes two disks 27*c* and 27*d* that are operatively engaged with the inner tubes 9*a* and 9*b*. The two discs 27*c* and 27*d* are connected via a gasket 29. The gasket 29 extends to the wall of the outer tube 7, dividing the inter tubular space 11 in two parts. Flows of air 35 and 37 are transported through the image-bearing roller 5 from the left to the right. The inter tubular space 11 and the intra tubular space 13 are divided in a first part upstream of the blocking element and a second part downstream of the blocking element. The ducts 31 in the blocking element guide the flow of air 35 from the upstream part of the inter tubular space 11 to the downstream part of the intra tubular space 13. The ducts 33 guide the air flow 37 from the upstream part of the intra tubular space 13 to the downstream part of the inter tubular space 11. In this manner, air flow 35 cools the first part of the roller surface and the air flow 37 cools the second part of the roller surface. The duct pair 31-33 forms a distorted double helix.

Figure 4:
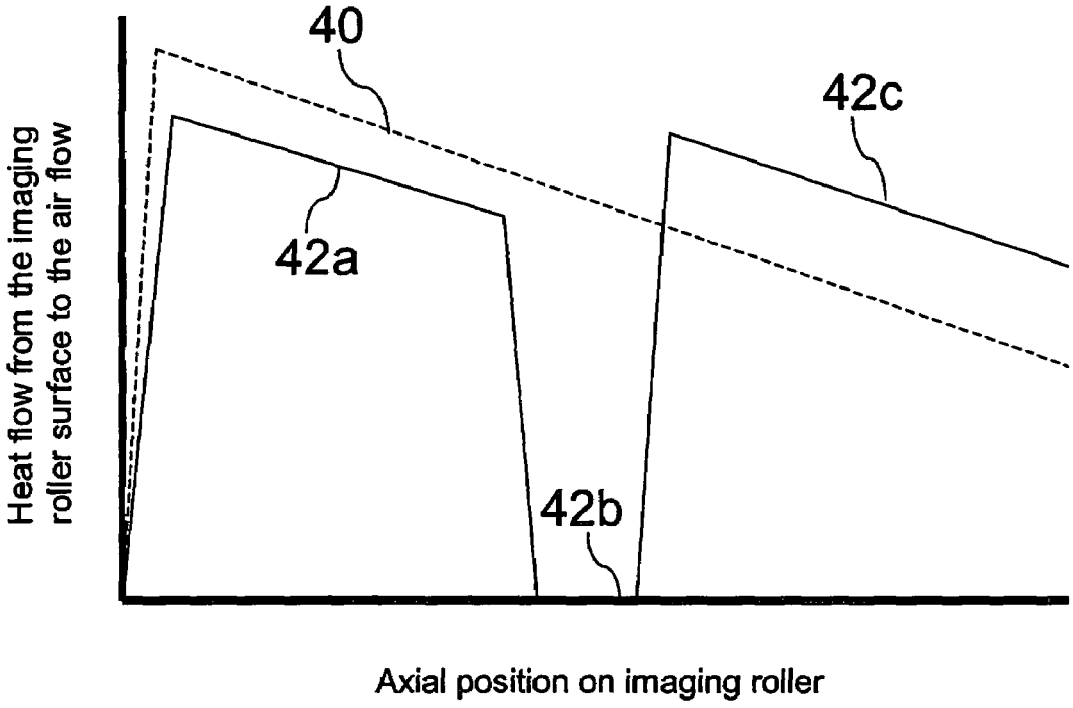
FIG. 4 is a graph showing the heat transfer from the roller surface to the air flow as a function of the axial position of the roller.

FIG. 4 shows a graph of the heat flow from the surface of the imaging roller to the air flow that passes though the roller as a function of the axial position of the roller. Trace 40 corresponds to the situation where the roller contains only an outer tube and an inner tube, without a blocking element and without any ducts. The heat flow from the imaging roller surface to the air flow steadily decreases when progressing along the longitudinal axis of the roller. This is due to the fact that the temperature of the air flow increases when passing through the roller. This results in a decrease of the temperature difference between the surface of the imaging roller and the air flow which results in a decreased heat flow. The heat flow in a steady state condition is viz. proportional to the temperature difference between the two bodies. The diminishing heat flow in the course of the roller results in a temperature gradient along the axis of the roller.

Trace 42*a*, 42*b*, 42*c* corresponds to the situation wherein the roller comprises an outer tube and an inner tube with a blocking element with concomitant ducts. The trace 42*a*, 42*b*, 42*c* consists of a first part 42*a* and a second part 42*c* which are divided by a dip 42*b*. The dip 42*b* is caused by the presence of the blocking element 27. Where the blocking element 27 contacts the inner surface of the outer tube, there is no air flow to carry away the heat from the surface of the roller. Trace 42*a* shows a decrease of the heat flow when progressing along the axis of the roller. This is due to the increasing temperature of the air flow in the inter tubular space 11 by the uptake of heat from the roller surface. When the air flow reaches the blocking element the air flow goes through the ducts and into the intra tubular space 13 on the other side of the blocking element 27 and then exits the roller. Simultaneously, the air flow that is blown into the first part of the intra tubular space reaches the blocking element 27. This air flow has maintained its initial temperature because it has not exchanged heat with the surface of the roller. This air flow passes through the ducts into the second part of the inter tubular space 11. Now, the air flow comes into heat exchanging contact with the surface of the roller. The heat flow from the surface of the roller to the air flow immediately reaches its maximum value, and then progressively decreases towards the end of the roller. The result is that the absolute differences in heat flow in trace 42 are significantly reduced with respect to trace 40. Dip 42*b* must be kept as narrow as possible in order to avoid overheating of the corresponding part of the roller surface. This is realized by using the embodiment of FIG. 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A roller for a printer, comprising:

an outer tube, said outer tube extending in an axial direction from a first end to a second end;

at least one inner tube positioned within the outer tube, said at least one inner tube extending substantially parallel to the outer tube, an inter tubular space being defined between the outer tube and the inner tube, and an intra tubular space being defined within the inner tube;

a blocking element, said blocking element dividing the inter tubular space and the intra tubular space into a first part extending substantially from the first end to the blocking element and a second part extending substantially from the blocking element to the second end; and a first duct and a second duct connecting the first part and the second part of the inter tubular space with the second part and first part, respectively, of the intra tubular space via the blocking element.

2. The roller for a printer according to claim 1, wherein the first duct and the second duct are arranged to form a double helix.

3. The roller for a printer according to claim 1, wherein the blocking element is not longer than 40 mm in the axial direction.

4. The roller for a printer according to claim 2, wherein the blocking element is not longer than 40 mm in the axial direction.

5. The roller for a printer according to claim 1, wherein the blocking element includes two parts joined together by a gasket.

6. The roller for a printer according to claim 2, wherein the blocking element includes two parts joined together by a gasket.

7. A printing system, comprising:

a roller, said roller comprising:

an outer tube, said outer tube extending in an axial direction from a first end to a second end;

at least one inner tube positioned within the outer tube, said at least one inner tube extending substantially parallel to the outer tube, an inter tubular space being defined between the outer tube and the inner tube, and an intra tubular space being defined within the inner tube;

a blocking element, said blocking element dividing the inter tubular space and the intra tubular space into a first part extending substantially from the first end to the blocking element and a second part extending substantially from the blocking element to the second end; and a first duct and a second duct connecting the first part and the second part of the inter tubular space with the second part and first part, respectively, of the intra tubular space via the blocking element.

8. The printing system according to claim 7, wherein the first duct and the second duct are arranged to form a double helix.

9. The printing system according to claim 7, wherein the blocking element is not longer than 40 mm in the axial direction.

10. The printing system according to claim 8, wherein the blocking element is not longer than 40 mm in the axial direction.

11. The printing system according to claim 7, wherein the blocking element includes two parts joined together by a gasket.

12. The printing system according to claim 8, wherein the blocking element includes two parts joined together by a gasket.

13. A method of cooling a surface of a roller for a printing system, said roller comprising an outer tube, said outer tube extending in an axial direction from a first end to a second end; at least one inner tube positioned within the outer tube, said at least one inner tube extending substantially parallel to the outer tube, an inter tubular space being defined between the outer tube and the inner tube, and an intra tubular space being defined within the inner tube; a blocking element, said blocking element dividing the inter tubular space and the intra tubular space into a first part extending substantially from the first end to the blocking element and a second part extending substantially from the blocking element to the second end; and a first duct and a second duct connecting the first part and the second part of the inter tubular space with the second part and first part, respectively, of the intra tubular space via the blocking element, said method comprising the steps of:

transporting air from the first end of the roller to the second end of the roller;

leading air that moves through the first part of the inter tubular space into the second part of the intra tubular space via the first duct in the blocking element; and leading air that moves through the first part of the intra tubular space into the second part of the inter tubular space via the second duct in the blocking element.

14. The method of cooling a surface of a roller for a printing system according to claim 13, further comprising the step of arranging the first duct and the second duct to form a double helix.

15. The method of cooling a surface of a roller for a printing system according to claim 13, further comprising the step of forming the blocking element not longer than 40 mm in the axial direction.

16. The method of cooling a surface of a roller for a printing system according to claim 14, further comprising the step of forming the blocking element not longer than 40 mm in the axial direction.

17. The method of cooling a surface of a roller for a printing system according to claim 13, wherein the blocking element includes two parts joined together by a gasket.

18. The method of cooling a surface of a roller for a printing system according to claim 14, wherein the blocking element includes two parts joined together by a gasket.

* * * * *